US006070944A

United States Patent [19]

LeBegue

[11] Patent Number: 6,070,944

[45] Date of Patent: Jun. 6, 2000

[54] PHASING VALVE ASSEMBLY FOR SUPPLYING WATER TO A MINING MACHINE CUTTER DRUM

[75] Inventor: Maurice K. LeBegue, Bluefield, W. Va.

[73] Assignee: Eimco LLC, Bluefield, W. Va.

[21] Appl. No.: 08/909,243

[22] Filed: Aug. 11, 1997

[51] Int. Cl.[7] ..... E21B 35/23

[52] U.S. Cl. ..... 299/12; 299/81.1; 299/81.2

[58] Field of Search ..... 299/12, 81.1, 81.2, 299/81.3

[56] References Cited

U.S. PATENT DOCUMENTS

| | | | |
|---|---|---|---|
| 3,374,033 | 3/1968 | Arentzen | 299/81 |
| 3,698,769 | 10/1972 | Amoroso | 299/73 |
| 3,767,265 | 10/1973 | French et al. | 299/81.2 |
| 3,876,254 | 4/1975 | Parker | 299/81 |
| 4,389,075 | 6/1983 | Kogler | 299/81 |
| 4,470,636 | 9/1984 | Paurat et al. | 299/81 |
| 4,565,410 | 1/1986 | Hotger | 299/81 |
| 4,585,275 | 4/1986 | Wrulich et al. | 299/81 |
| 4,621,869 | 11/1986 | Parrott | 299/81 |
| 4,660,892 | 4/1987 | Demoulin | 299/81.2 |
| 4,721,341 | 1/1988 | Maschewski | 299/81 |
| 4,755,002 | 7/1988 | Parrott | 299/81 |
| 4,852,947 | 8/1989 | Jones | 299/81.2 |
| 5,054,858 | 10/1991 | Harrison | 299/81 |
| 5,098,166 | 3/1992 | Ebner et al. | 299/81 |
| 5,143,423 | 9/1992 | LeBegue et al. | 299/76 |
| 5,507,565 | 4/1996 | LeBegue et al. | 299/12 |
| 5,690,392 | 11/1997 | Clapham | 299/81.1 |

FOREIGN PATENT DOCUMENTS

| | | |
|---|---|---|
| 2 225 079 | 11/1986 | European Pat. Off. . |
| 2 089 869 | 10/1981 | United Kingdom . |
| 2 189 531 | 4/1986 | United Kingdom . |
| 2 217 758 | 4/1989 | United Kingdom . |
| 2217758 | 4/1989 | United Kingdom . |
| 2 296 271 | 6/1996 | United Kingdom . |
| 2296271 | 6/1996 | United Kingdom . |
| WO 95/14846 | 11/1994 | WIPO . |

*Primary Examiner*—Eileen Dunn Lillis
*Assistant Examiner*—John Kreck
*Attorney, Agent, or Firm*—Price & Adams

[57] ABSTRACT

A boom mounted cutter drum assembly of a continuous mining machine includes a center drum section, a pair of intermediate drum sections, and a pair of end drum sections. Spray nozzles on the cutting elements of the cutter drum assembly phasingly direct liquid spray at the mine face as mine material is dislodged to suppress dust and frictional ignition. Liquid for the spray nozzles is supplied on the mining machine through stationary annular housings positioned between the intermediate drum sections and the end drum sections. Water is conveyed through passageways in the annular housings to corresponding passageways in a sealing and valving assembly located in the end drum sections having stationary and rotating components. The gear case is surrounded on one side by a cat seal and on the other side by a lip seal to prevent liquid leakage from flowing into the gear case. Also, a leakage passageway is provided in communication with the passageways in the seal and valving assembly to permit liquid leakage to flow to atmosphere. The passageways in the sealing and valving assembly phasingly communicate with axial liquid passageways. The axial liquid passageways lead through the end drum section and into various zones in the end drum sections, the intermediate drum sections, and the center drum section to phasingly supply liquid to the spray nozzles located on the cutting elements as they dislodge material from the mine face.

23 Claims, 10 Drawing Sheets

PHASING VALVE ASSEMBLY FOR SUPPLYING WATER TO A MINING MACHINE CUTTER DRUM

BACKGROUND OF THE INVENTION

1. Field of the Invention

This invention relates to method and apparatus for suppressing dust and frictional ignition in the operation of a continuous mining machine and, more particularly, to a continuous mining machine having a cutter drum equipped with a rotary valving assembly for supplying water to the portion of the cutter drum where it is needed to suppress the generation of dust and the occurrence of frictional ignition.

2. Description of the Prior Art

In underground mining operations using drum-type continuous miners, cutter drums extending from the front of the machine are provided with cutting bits and are moved into engagement with the mine face to dislodge solid material therefrom. It is well known in the art to locate water spray nozzles on the cutting drum near each bit to suppress the generation of airborne dust and frictional ignition as the cutter bits engage the mine face.

Utilization of spray nozzles adjacent the cutter bits on the surface of the cutter drum has been found to effectively suppress dust before it becomes airborne. The water is continuously sprayed from the nozzles during rotation of the cutter drum, suppressing dust at the point where the material is dislodged from the mine face. Generating a water spray at the bits suppresses the dust at its source and effectively eliminates any risk of frictional ignition as the cutter bits strike the solid material. Generating a spray from the nozzles also serves to extend the life of cutter bits on the cutter drum.

Examples of mining machines equipped with cutter drums having dust suppressing spray nozzles are disclosed in U.S. Pat. Nos. 3,698,769, 3,876,254, 4,565,410, and 5,507,565.

With the above described spray devices, water is continuously supplied to the nozzles regardless of their position relative to the mine face. In many applications, it is necessary to conserve the amount of water used in the spraying operation as well as reduce the amount of mud produced by the combination of the dust and the water. Control of these features may be achieved by phasing the supply of the water to the spray nozzles. By phasing the water supply, only the spray nozzles positioned adjacent to the cutter bits engaging the mine face are supplied with water. Phasing of the water supplied to the spray nozzles can conserve as much as 50% of the water used for dust suppression during the mining operation.

A number of systems have been proposed for phasing the water supply to the spray nozzles. For example, U.S. Pat. No. 3,374,033 discloses a mining machine having a boom supported cutter drum in which a liquid inlet extends through each boom member from a pressurized water source. The water is directed through the inlet into a non-rotatable housing which supports the cutter drum. From the housing, the water flows through a non-rotatable annular valve ring. The valve ring is designed to permit water to travel through only a pre-determined 90° arc corresponding to the point of contact between the cutter drum and the mine face. Thus water is supplied to only one quarter of the spray nozzles at any given time. A rotatable, annular port plate is connected to the cutter drum and includes ports through which the water travels to the spray nozzles.

U.S. Pat. No. 4,470,636 discloses a phased water delivery system for use with an auger style mining machine. Water is supplied through a stationary tube into a reservoir between a stationary tube housing and a rotatable valve body. From this reservoir, the water contacts a stationary annular valve plate which limits the water to advancing only through a predetermined arc. This valve plate is aligned with a port plate having ports each leading to a tube. The tubes, in turn, lead to nozzles which spray water onto the mine face.

U.S. Pat. No. 5,098,166 discloses a method of gearing a cutter drum which permits the center of the drum to remain stationary while the outer portion of the cutter drum rotates. Pressurized water is supplied from a stationary boom member into an axial bore through the fixed center of the drum. The water is conveyed to a stationary annular valve plate adjacent the end of the drum having openings along a limited range of its circumference. The valve plate lies adjacent to a port plate which rotates along with the outer portion of cutter drum. The port plate has bores therethrough aligned with passageways which lead to the spray nozzles. In this manner, the water is only supplied to the spray nozzles during a desired portion of the drum rotation.

Other examples of the use of water sprays to suppress dust generated during the material dislodging operation of a mining machine are disclosed in U.S. Pat. Nos. 4,389,075; 4,621,869; 4,721,341; 4,755,002; and 5,054,858.

With the above described devices, conventional seal rings are used to provide a rotary seal between the stationary and rotary components of the cutter drum. The large diameter rotary seals required for use with continuous mining machines must operate for an extended period of time in a dust filled environment to prevent leakage of the spray liquid into the bearings or the gearcase. Failure of these seals can result in costly damage to the cutter drum components.

The port plates in the above-described devices supply water only to the spray nozzles in one section of the cutter drum. Therefore, there is a need for a phased dust suppressing apparatus that minimizes inevitable damage caused by ineffective rotary seals.

There is further need for a phased dust suppressing apparatus in which spray nozzles on a plurality of sections of the cutter drum are supplied by a single phasing valve.

SUMMARY OF THE INVENTION

In accordance with the present invention, there is provided a phasing valve assembly for supplying liquid to a cutter drum of a mining machine that includes a body portion and boom member. A cutter drum assembly is rotatably mounted on the boom member. Cutting elements are secured to the cutter drum assembly and extend therefrom. Bearing means rotatably support the cutter drum assembly on the boom member. Power means is mounted on the body portion for rotating the cutter drum assembly. Drive means transmits rotation from the power means through the boom members to the cutter drum assembly. Spray nozzles carried by the cutting elements direct a liquid spray from the cutting elements during rotation of the cutter drum assembly. Conduit means stationarily extend from said body portion through the boom member for supplying liquid to the spray nozzles on the cutter drum assembly. A valving mechanism is positioned in the cutter drum assembly for selectively limiting the flow of liquid from the conduit means to the spray nozzles. Liquid passageways extend through the cutter drum assembly and are rotatable therewith to direct liquid from the valve mechanism to the spray nozzles. Sealing means direct liquid from the stationarily positioned conduit means to the rotatable liquid passageways while preventing leakage of liquid into contact with the bearing means.

Drainage means extends from the sealing means through the cutter drum assembly for diverting leakage away from the bearing means and externally out of the cutter drum assembly.

Further in accordance with the present invention there is provided apparatus for supplying phased liquid to a cutter drum assembly of a mining machine including a body portion and a boom member. A cutter drum assembly is rotatably mounted on the boom member. The cutter drum assembly has a pair of end drums, a pair of intermediate drums, and a center drum. Cutting elements are secured to the cutter drum assembly and extend therefrom for removing material from a mine face. Power means are mounted on the body portion for rotating the cutter drum assembly. Drive means transmits rotation from the power means through the boom member to the cutter drum assembly. Spray nozzles carried by the cutting elements direct a liquid spray from the cutting elements to the mine face during rotation of the cutter drum assembly. Conduit means stationarily extend from the body portion through the boom member for supplying liquid to the cutter drum assembly. Porting means rotatably connected to the conduit means supplies liquid in phases to the spray nozzles during engagement of the cutting elements with the mine face. The porting means include an annular port plate positioned axially in the cutter drum assembly. The port plate has a plurality of ports therein. Each of the ports is connected to a series of corresponding liquid passageways in the cutter drum assembly. The liquid passageways include end drum passageways, intermediate drum passageways and a center drum passageway. The end drum passageways are positioned adjacent the outside diameter of the end drums for directing water to the nozzles in the end drums. The intermediate drum passageways are positioned axially in the cutter drum assembly for directing water to the nozzles in the intermediate drum assemblies. The center drum passageway extends along the centerline of the cutter drum assembly for directing water to the nozzles in the center drum. The liquid passageways operate to supply water simultaneously to said spray nozzles positioned in the end drums, the intermediate drums, and the center drum.

The present invention is also directed to a method for supplying liquid in phases to a cutter drum assembly of a mining machine comprising the steps of rotatably supporting a cutter drum assembly on a boom member extending forwardly of the mining machine. Cutting elements are secured to the surface of the cutter drum assembly. The cutter drum assembly is rotated in contact with a mine face to dislodge solid material therefrom by the cutting elements. Spray nozzles are positioned on the surface of the cutter drum assembly adjacent to the cutting elements. A liquid spray is directed from the nozzles during rotation of the cutter drum assembly. Liquid is conveyed through a stationary strut from the boom member into the cutter drum assembly. The cutter drum assembly is divided into a plurality of sections. Each section of the cutter drum assembly is divided into a plurality of zones for distributing liquid to the nozzles on the respective sections of the cutter drum assembly. The liquid is directed from the stationary strut into a passageway within the cutter drum assembly. The passageway is sealed to prevent liquid from escaping out of the cutter drum assembly. The passageway through the cutter drum assembly is obstructed to limit the liquid flow into a manifold occupying a radial segment of the passageway for supplying liquid to the nozzles positioned oppositely of the mine face. The liquid from the manifold is conveyed to a ported plate positioned in fluid communication with the zones for distributing liquid to the nozzles. The liquid is directed to the ported plate for distribution to each section of the cutter drum assembly for supplying the zones with liquid to emit from the nozzles a liquid spray only during the phase of rotation of the cutter drum assembly when the nozzles are positioned oppositely of the mine face.

Accordingly, a principal object of the present invention is to provide on a mining machine having a cutter drum a single phasing valve assembly for supplying water at selected intervals to a plurality of sections of the cutter drum.

Another object of the present invention is to provide a seal system for the cutter drum of a mining machine having cutter bits supplied with spray nozzles where water is supplied to the nozzles during a selected phase in the rotation of the cutter drum and a leakage path for the water is provided away from the bearings and gearing of the cutter drum.

These and other objects of the present invention will be more completely disclosed and described in the following specification, accompanying drawings, and appended claims.

DESCRIPTION OF THE PREFERRED EMBODIMENTS

Figure 1:
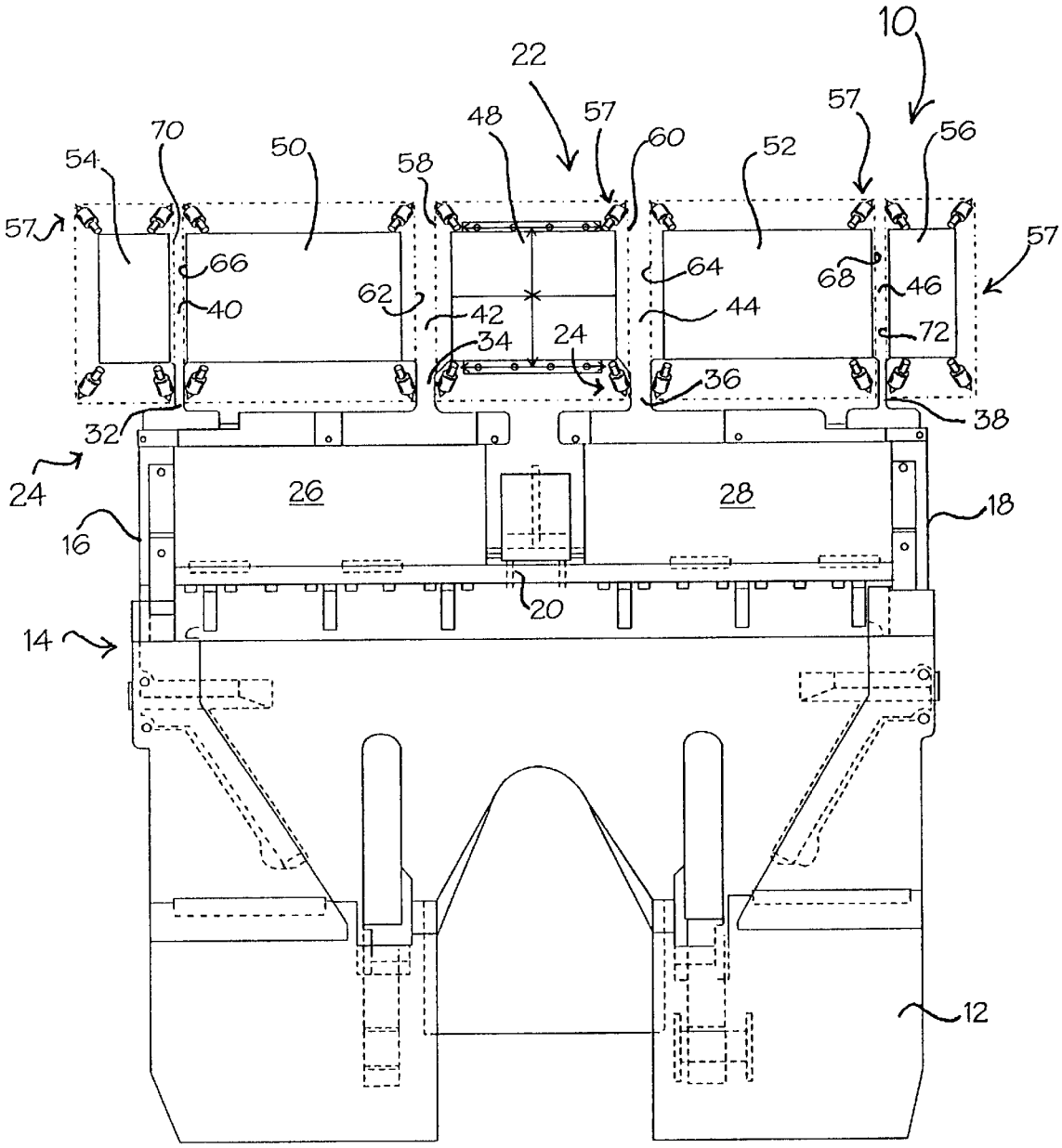
FIG. 1 is a schematic plan view of a continuous mining machine boom member, illustrating a cutter drum assembly rotatably supported by the boom member.
Figure 2:
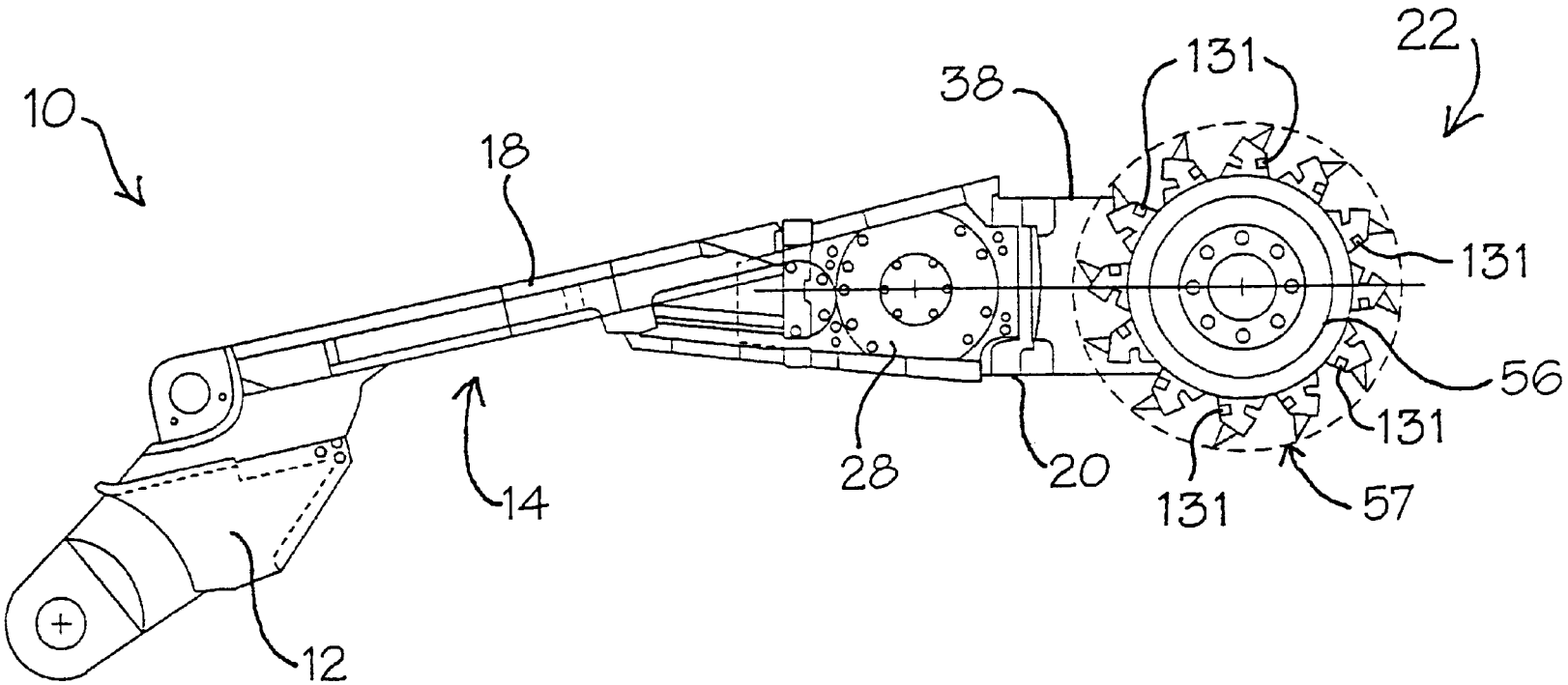
FIG. 2 is a side elevantional view of the mining machine boom member shown in FIG. 1, illustrating the cutter drum assembly supported by the boom member.

Referring to the drawings and particularly to FIGS. 1 and 2, there is illustrated the front end of a continuous mining machine generally designated by the numeral 10 having a body portion 12 mounted on a crawler track propelled prime mover or tractor portion (not shown) that advances the mining machine in a mine. An endless conveyor mechanism (not shown) extends longitudinally on the mining machine and conveys dislodged material from the front end 10 of the mining machine to a conveyor discharge end portion at the rearward end of the machine where the mined material is transferred to another conveyance system for movement out of the mine.

A forwardly extending boom member generally designated by the numeral 14 includes a pair of parallel arm members 16 and 18 that extend forwardly from the machine body portion 12 and are connected to each other by a traverse housing 20. The arm members 16 and 18 are pivotally connected to the tractor portion or prime mover of mining machine and to piston cylinder assemblies (not shown). Actuation of the piston cylinder assemblies pivots the arm members 16 and 18 about their connections to the mining machine to move the boom member 14 vertically upwardly and downwardly. In this manner, a cutter drum assembly 22 executes an upward or downward shear cut of a mine face. The cutter drum assembly 22 is rotatably supported on the end of the boom member 14.

Figure 3:
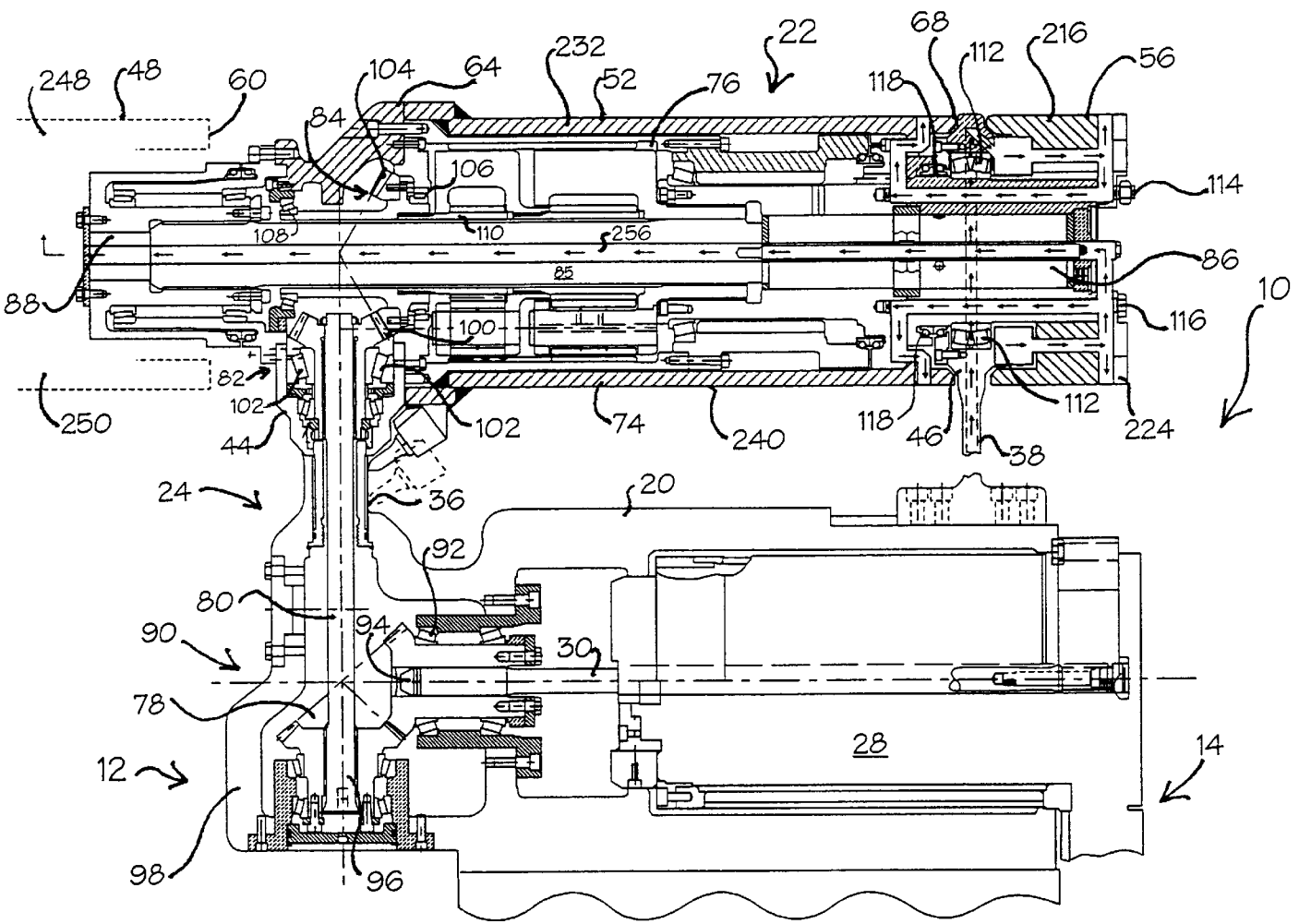
FIG. 3 is a schematic sectional view of one end drum section and one intermediate drum section of the cutter drum assembly shown in FIG. 1, illustrating seal and valve arrangements for phasingly conveying water into and through both drum sections.

The cutter drum assembly 22 is supported by a drum housing generally designated by the numeral 24 connected to the boom member transverse housing 20. A pair of cutter drum motors 26 and 28 are mounted on the boom member transverse housing 20 and are each drivingly connected to a motor shaft 30, as shown in FIG. 3. Each motor shaft 30 transmits rotation from the respective motors 26 and 28 through the non-rotatable drum housing 24 to the cutter drum assembly 22.

As shown in FIG. 1, the drum housing 24 includes four arm members 32, 34, 36 and 38 which extend from the transverse housing 20 of the boom member 14. Four non-rotatable annular housing portions 40, 42, 44 and 46 extend forwardly from the drum housing arm members 32, 34, 36 and 38. The rotatable portions of the cutter drum assembly are mounted on the non-rotatable annular housing portions 40, 42, 44 and 46. The drive shafts for the cutter drum assembly 22 extend through the annular housing portions 40, 42, 44 and 46 and are connected to the drive gearing for rotating the cutter drum assembly 22 to dislodge material from the mine face.

As further shown in FIG. 1, the cutter drum assembly 22 includes a center drum section 48, a pair of intermediate drum sections 50 and 52 and a pair of end drum sections 54 and 56. The center drum section is rotatably supported by the annular housing portions 42 and 44. The center drum section has outer annular edge portions 58 and 60 spaced from inner annular edge portions 62 and 64 of the intermediate drum sections 50 and 52, respectively.

The intermediate drum sections 50 and 52 have outer annular edge portions 66 and 68 spaced from inner annular edge portions 70 and 72 of the end drum sections 54 and 56, respectively. The annular housing portions 40, 42, 44 and 46 extend into the openings between the center drum section and the intermediate drum sections and the intermediate drum sections and the end drum sections, respectively. In this manner, the drum sections 48, 50, 52, 54 and 56 are rotatably supported relative to the fixed annular housing portions 40, 42, 44 and 46.

As shown in FIGS. 1 and 2, the drum sections 48, 50, 52, 54 and 56 include a plurality of cutting elements generally designated by the numeral 57 that extend peripherally from the respective drum sections. The cutting elements 57 are positioned on the surface of the respective drum sections in a preselected bit pattern formed by rows of cutting elements mounted on the peripheral surfaces of the drum sections. The cutting elements 57 are positioned on the respective drum sections 48, 50, 52, 54 and 56 in a preselected pattern to dislodge a continuous kerf from the mine face without leaving unmined portions in the face. As the cutter drum assembly 22 rotates, it executes a shear cut in the mine face and forms a relatively horizontal roof and floor in the mine passageway.

Now referring to FIGS. 3–7 in which like numerals throughout the figures identify like parts, there is illustrated in FIG. 3 the gearcases within the end drum section 56 and the intermediate drum 52. The center drum section 48 as well as the opposing intermediate and end drum sections 50 and 54 are omitted for purposes of clarity of illustration. Each of the intermediate drum sections 50 and 52 and end drum sections 54 and 56 are identical in that water is supplied to both end drum sections for distribution to the cutting elements 57 on the surfaces of drums sections 48, 50, 52, 54 and 56. The flow of water through passageways in the center drum section is schema-tically illustrated by the directional arrows in FIG. 1.

As illustrated in FIG. 3, intermediate drum section 52 has a cylindrical shaped body portion 74 having inner annular edge portion 64 and outer annular edge portion 68. A drive shaft 76 is connected to the body portion 74 by suitable fastening devices to transmit rotation to the body portion 74.

Rotation from the drum rotating motor 28 is transmitted to the drive gearing of the cutter drum assembly 22. Motor 28 is drivingly connected by motor shaft 30 through a bevel gear 78 to input drive shaft 80 to a bevel pinion gear set generally designated by the numeral 82. The bevel pinion gear set 82 transmits rotation to a planetary gear assembly generally designated by the numeral 84. The planetary gear assembly 84 then transmits rotation to the intermediate drum shaft 76 to rotate the intermediate drum section 52. In turn, intermediate drum shaft 76 is non-rotatably connected to an axial drive shaft 85. The axial drive shaft 85 is connected at one end to the end drum drive shaft 86 for rotating the end drum section 56 and at its opposite end to the center drum drive shaft 88 for rotating the center drum section 48.

Drum housing 24, shown in detail in FIG. 3, includes gear housing 90 for receiving the drive connection from motor 28. The gear housing 90 is formed integral with annular housing portion 44. The intermediate drum section 52 and the center drum section 48 are rotatably mounted on the annular housing portion 44. The motor drive shaft 30 extends into the gear housing 90 where it is rotatably supported by bearings 92 and includes a splined end portion 94 that meshes with a bevel gear set 78. Bevel gear set 78 transmits rotation from motor shaft 30 to a splined end portion 96 of input drive shaft 80. The input drive shaft 80 is rotatably supported within the gear housing 90 by bearings 98.

The bevel pinion gear set 82 shown in FIG. 3 includes a pinion 100 splined to the outer end portion of input drive shaft 80. The pinion 100 is supported by bearings 102 in annular housing portion 44 and meshes with a bevel gear 104. The bevel gear 104 is rotatably supported within the intermediate drum section 52 by bearings 106 and 108.

The bearings 106 and 108 are positioned in surrounding relation with a shaft portion of the bevel gear 104 by a bearing carrier that is bolted to the non-rotatable annular housing portion 44. This arrangement maintains the bearings 106 and 108 in position for rotatably supporting the bevel gear 104.

A shaft portion of the bevel gear 104 is connected to a splined portion of a sun gear 110 of the planetary gear assembly 84. With this arrangement, rotation of the input shaft 80 is transmitted by the pinion gear 100 to the bevel gear 104 and therefrom to the sun gear 110. The sun gear 110 includes an axial bore through which axial drive shaft 85 extends. The sun gear 110 is rotatable about the axial drive shaft 85.

Figure 4:
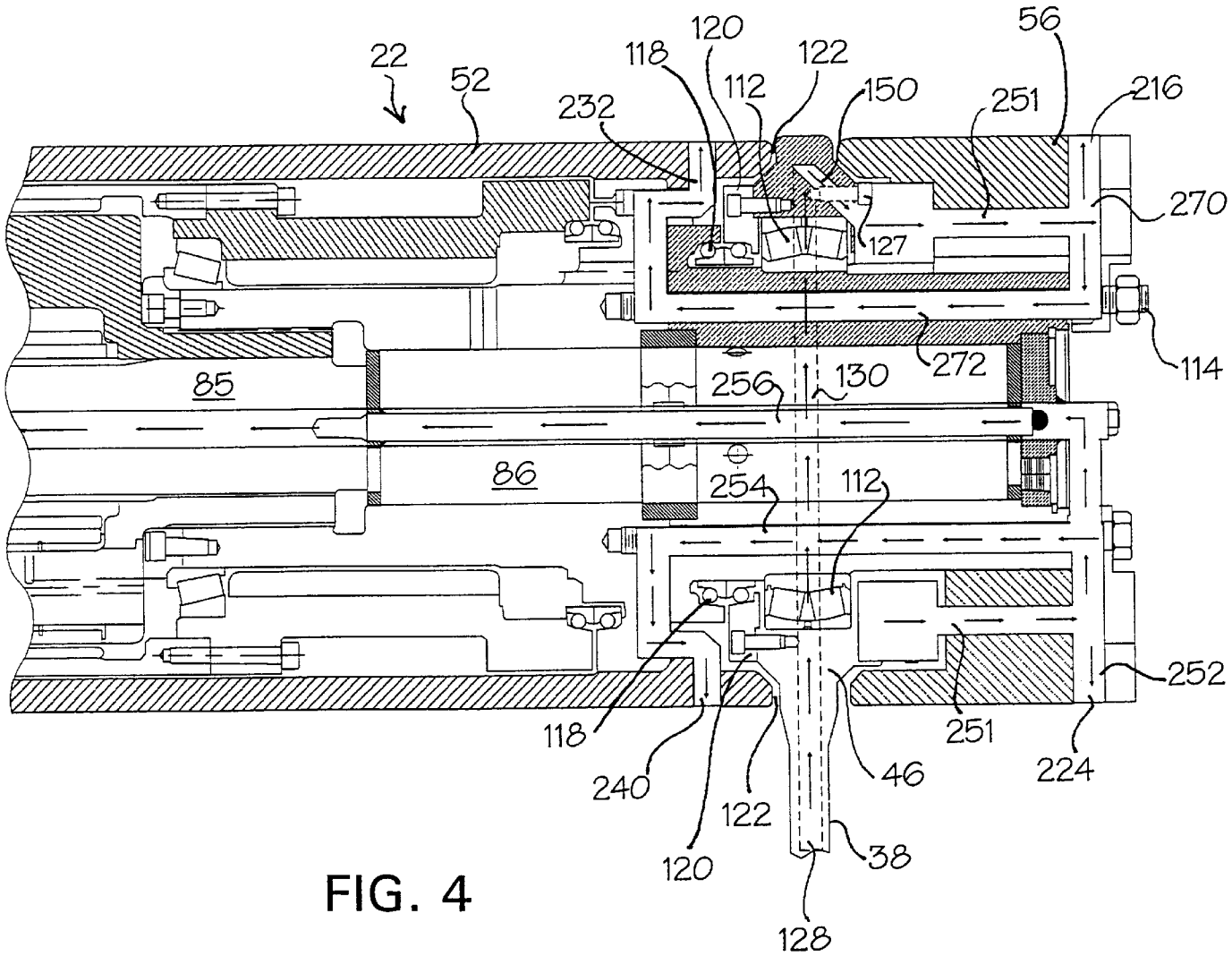
FIG. 4 is an enlarged fragmentary sectional view of the end drum section shown in FIG. 3, illustrating the seal and valve arrangements for the phased water flow through the end drum section.

Now referring to FIG. 4, there is illustrated in greater detail end drum section 56 and a portion of intermediate drum section 52 where they connect at fixed annular housing portion 46. For the purposes of brevity, it may be assumed that the relation between drum sections 50 and 54 and annular housing portion 32, shown in FIG. 1, are symmetrically identical to those described below. Drum housing arm member 38 supports fixed annular housing portion 46. End drum drive shaft 86 extends through annular housing portion 46 and is supported therein by bearing assembly 112. As illustrated in FIGS. 3 and 4, end drum portion 56 is connected to end drum drive shaft 86 by bolts 114 and 116.

As shown in FIG. 4, bearing assembly 112 is protected from liquid contamination by two sets of seals. On the interior side of the bearing assembly 112 is cat seal 118. Cat seal 118 is supported by cat seal carrier 120 integrated with annular housing portion 46. The exterior side of bearing assembly 112 is protected by lip seal 124, shown in FIGS. 5 through 7. Lip seal 124 is supported by lip seal carrier 125 bolted to the outside surface of annular housing portion 46 by bolts 127. Lip seal 124 is another unidirectional seal that allows grease to be flushed through it, yet does not allow water or other contamination to leak into the bearing assembly 112. As illustrated in FIGS. 5–7 and 9, grease flushed through lip seal 124 is directed, along with any water leakage that may occur, through a radial passageway 126 (FIG. 10) in lip seal carrier 125 to atmosphere.

Figure 8:
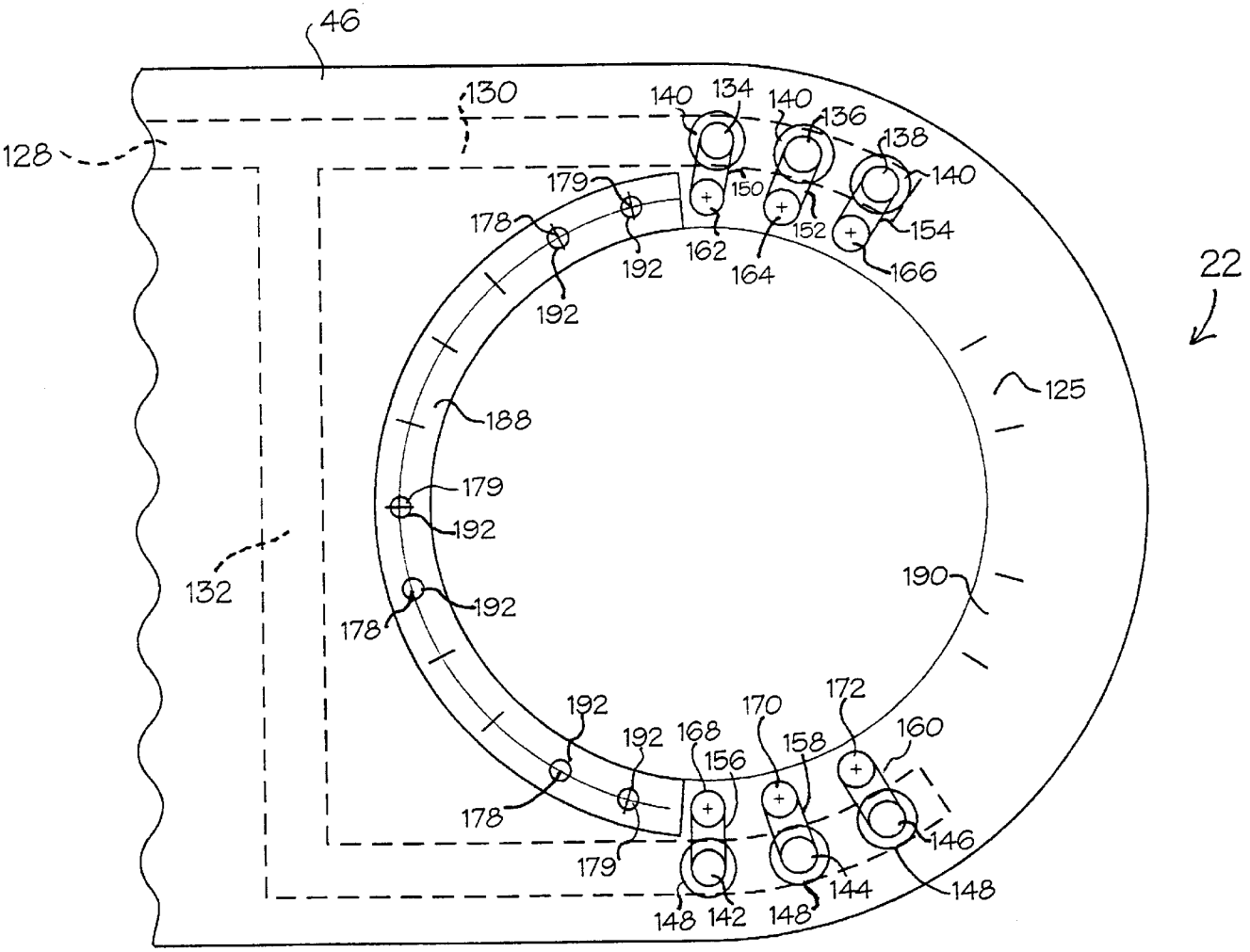
FIG. 8 is a fragmentary view in side elevation of the valve plate assembly taken along line VIII—VIII in FIG. 5, illustrating the water flow paths through the valve arrangement.
Figure 10:
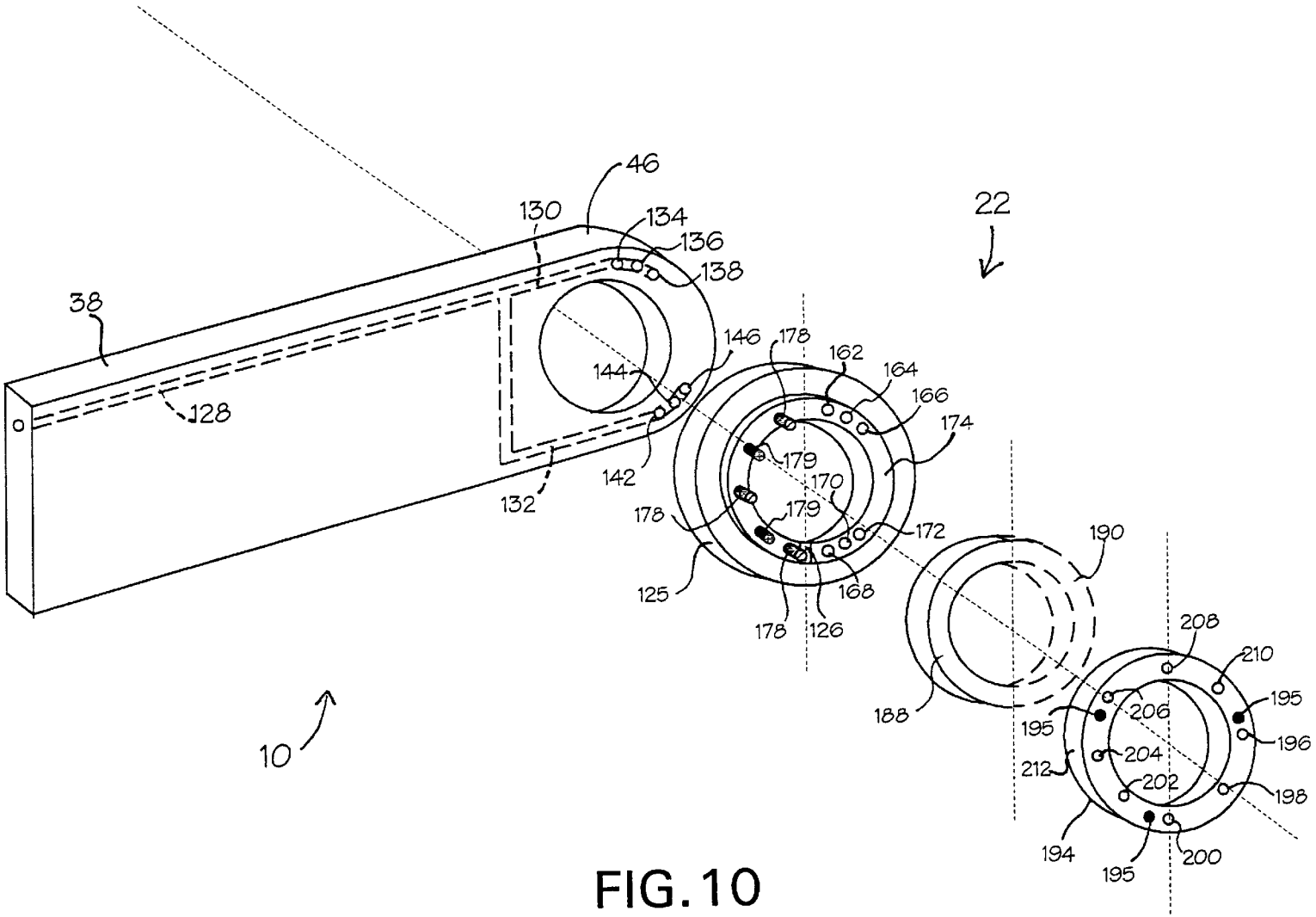
FIG. 10 is a schematic isometric view of the valve arrangement shown in FIG. 3, illustrating the relationship between the sealing and valving components.

As shown in FIG. 4, drum housing arm member 38 includes a water passageway 128 through which water from a source (not shown) on the mining machine body portion 12 extends into the cutter drum assembly 22. Water passageway 128, as shown in FIGS. 8 and 10, extends through annular housing portion 46 and branches into two passageways 130 and 132. Passageway 130 extends through annular housing portion 46 above the cutter drum drive shaft 86 and past the centerline thereof.

As shown in FIG. 8, passageway 130 exits into three ports 134, 136 and 138 located in the outside surface of annular housing portion 46. Each port 134, 136 and 138 is surrounded by an O-ring 140 to prevent leakage into the bearing assembly 122. Passageway 132 first extends downwardly to a position below the end drum drive shaft 86 and then forwardly through annular housing portion 46 past the centerline. Passageway 132 ends in three ports 142, 144 and 146 located in the outside surface of annular housing portion 46. Each port 142, 144 and 146 is also surrounded by O-ring 148. Additional O-ring 129, shown in FIGS. 5–7, surrounds the bearing assembly 112 and redundantly protects it from leakage past O-rings 140 and 148.

Figure 5:
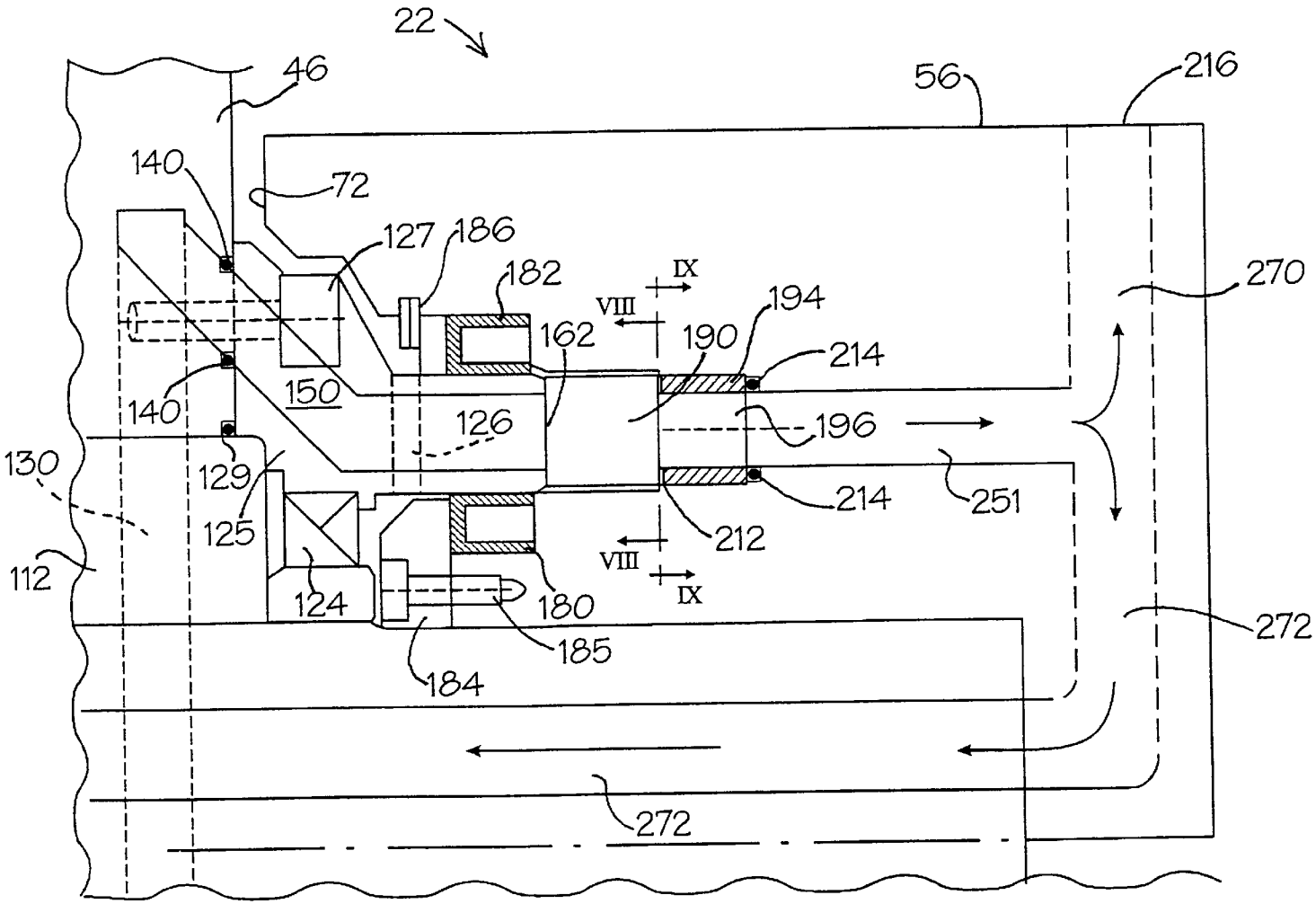
FIG. 5 is an enlarged fragmentary view of the front half of the end drum section shown in FIG. 4, illustrating the seal and valve arrangements.
Figure 6:
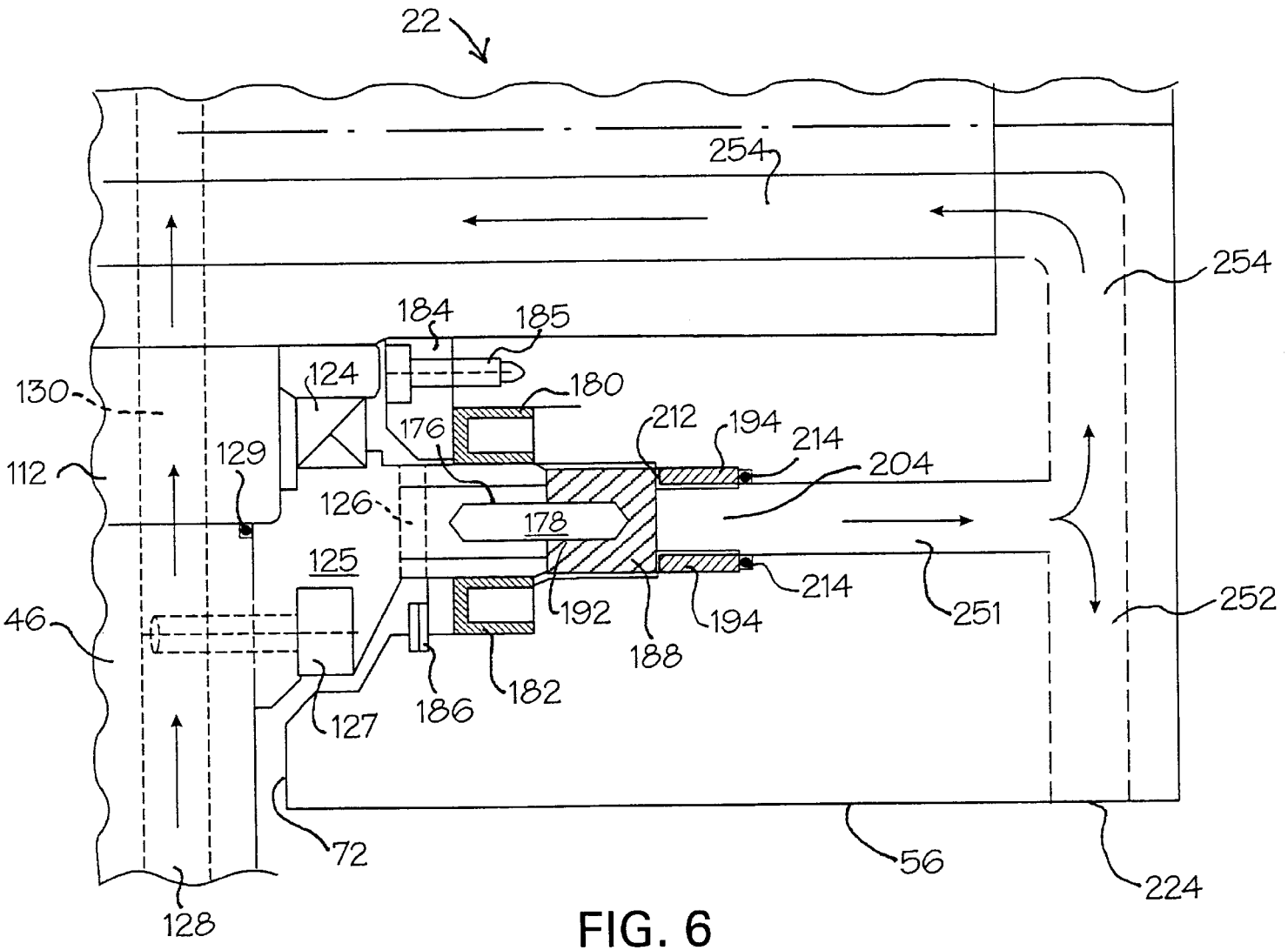
FIG. 6 is an enlarged fragmentary view of the rearward half of the end drum section shown in FIG. 4, illustrating the seal and valve arrangements.

Lip seal carrier 125 shown in FIGS. 5–7 and 10 extends through a diameter greater than the location of ports 134, 136, 138, 142, 144 and 146 and contains corresponding passageways 150, 152, 154, 156, 158 and 160 (FIG. 8) therein, which allow water to pass through the interior of lip seal carrier 125 to ports 162, 164, 166, 168, 170 and 172 positioned on the front half of bolt circle 174 which comprises the outside surface of the lip seal carrier 125, as illustrated in FIGS. 8 and 10. Also, lip seal carrier 125 contains a radial passageway 126 (FIG. 10) drilled therethrough which allows grease and leakage to be flushed from the lip seal 124 and vented to the atmosphere. The back half of bolt circle 174 (FIG. 10) includes a plurality of shallow, uniform holes 176; one of which is shown in FIG. 6. Holes 176 receive dowel pins 178 and springs 179 (FIG. 10) whose purposes will be described later in greater detail.

Figure 7:
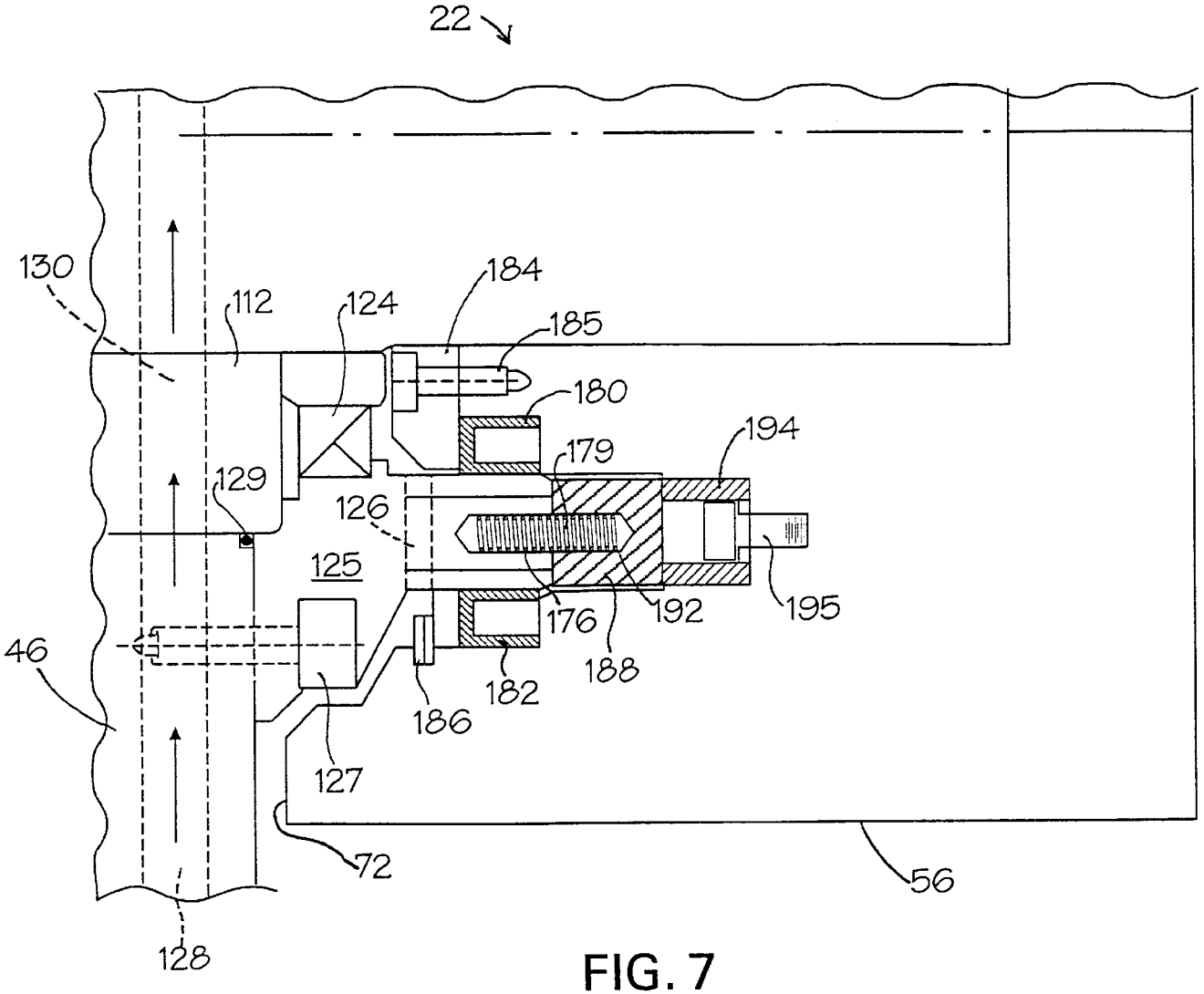
FIG. 7 is an enlarged fragmentary view similar to FIG. 6, illustrating in a different cross-sectional plane of the end drum section additional components of the seal and valve arrangements.

Referring now to FIGS. 5–7, the outside portion of lip seal carrier 125 is contacted by a pair of concentric U-cups 180 and 182. Inside U-cup 180 is non-rotatably mounted to end drum 56 by inner seal retainer plate 184 and retainer plate bolt 185 and rotates with the end drum 56. Outside U-cup 182 is nonrotatably mounted to end drum 56 by snap ring 186, and it also rotates with the end drum 56. The action of U-cups 180 and 182 allows the end drum 56 to ride on the outer surface of lip seal carrier 125. The smaller diameter U-cup 180 has a dynamic sealing surface on its outer diameter. The larger diameter U-cup 182 has a dynamic sealing surface on its inner diameter to prevent leakage of water to atmosphere.

Referring now to FIGS. 6, 8 and 10, located adjacent to the rearward half of bolt circle 174 for lip seal carrier 125 is carbon valve plate 188. Valve plate 188 is nonrotatably connected to lip seal carrier 125 and extends around 170° of the drum to obstruct water flow through the ports of the lip seal carrier. A manifold 190 in the shape of an annular portion (shown in phantom in FIG. 10) of 190° remains open adjacent to the front half of bolt circle 174 of lip seal carrier 125. As water passes through ports 162, 164, 166, 168, 170 and 172 in lip seal carrier 125, it fills manifold 190 with a solid cross-section of water. There is no water flow in the passageways covered by valve plate 188. Water flows only into the manifold 190 which occupies a 190° radial segment of the passageways through the lip seal carrier 125.

The inside surface of valve plate 188 contains holes 192 shown in FIGS. 6 and 8 aligned with holes 176 in the back half of bolt circle 174. Dowel pins 178 (FIG. 6) are loosely positioned in approximately half of the corresponding holes 176 and 192 to prevent valve plate 188 from rotating relative to lip seal carrier 125. Springs 179 are positioned, as shown in FIG. 7, in the remaining corresponding holes 176 and 192 to exert a pressure forcing the valve plate 188 away from lip seal carrier 125.

Figure 9:
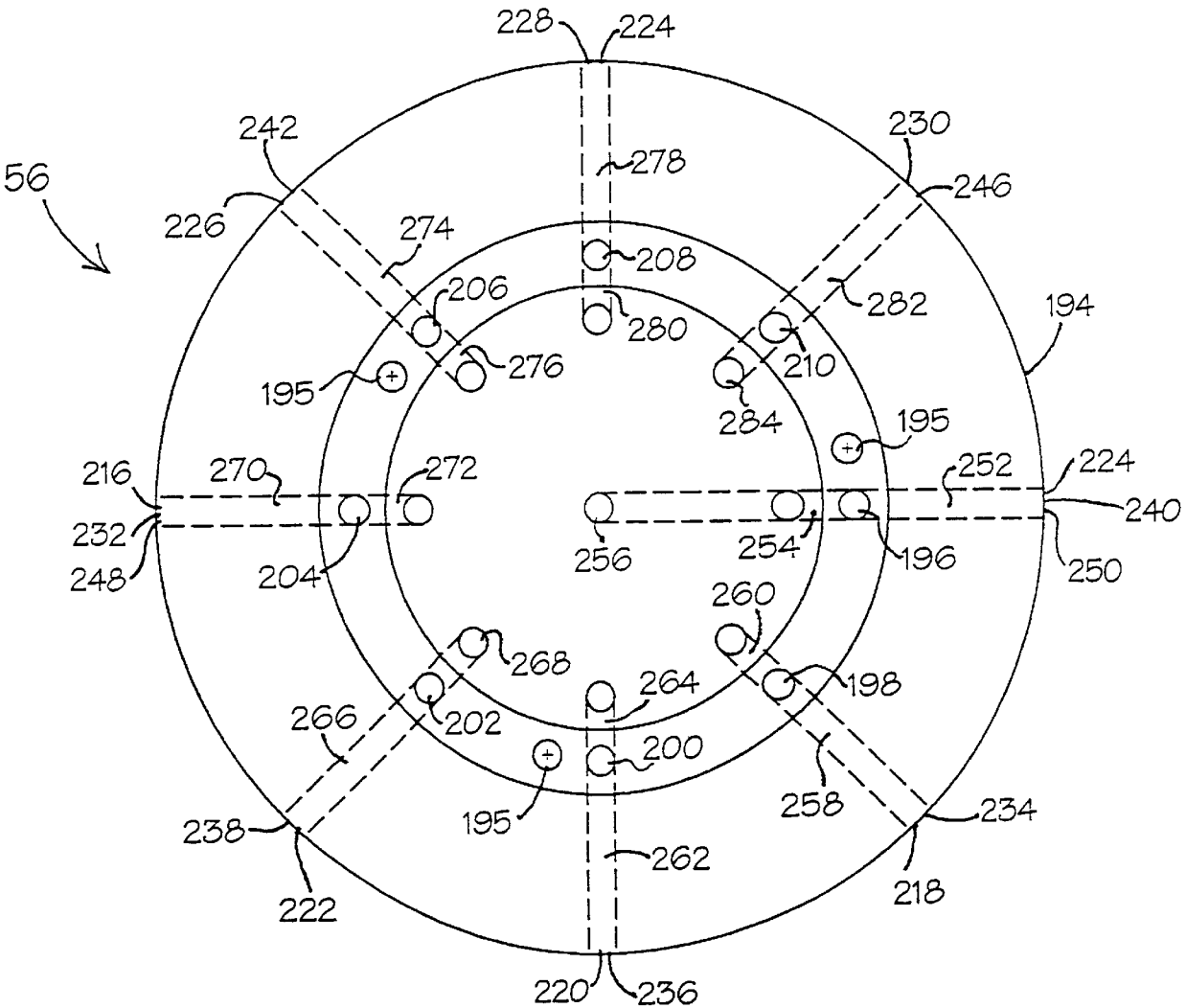
FIG. 9 is an enlarged view in side elevation of the port plate taken along line IX—IX in FIG. 5.

As shown in FIGS. 6, 9 and 10, located adjacent to the outer surface of valve plate 188 and manifold 190 is an annular port plate 194. Port plate 194 is nonrotatably connected to end drum 56 by three bolts 195 (FIG. 9) spaced around the port plate 194 to rotate with the drum. Port plate 194 includes eight spaced holes 196, 198, 200, 202, 204, 206, 208 and 210 extending completely through it, from its inside surface to its outside surface. The inside surface of port plate 194 includes a ceramic face 212 (FIG. 6) against which the outside surface of valve plate 188 is forced. The outside end of each hole 196–210 is surrounded by an O-ring 214 to prevent leakage into the end drum 56.

As end drum 56 rotates about end drum drive shaft 86, port plate 194 rotates against stationary valve plate 188. Therefore, the water contained in the manifold 190 passes through holes 196–210 for distribution to zones on the cutter drum 22 for spraying water from the nozzles associated with each cutting element 57. Holes 196–210 are free from obstruction by valve plate 188. Due to the spaced relationship of the holes 196–210 and the fact that the manifold 190 extends through a 190° radial segment of a possible 360°, at any given point, five of the eight holes 196–210 receive water for distribution to selected zones on the cutter drum 22 for spraying water confined to the mine face.

As seen in FIG. 9, the outer surface of end drum 56 is broken up into eight equally sized zones 216, 218, 220, 222, 224, 226, 228, and 230. Each zone communicates with a spray nozzle 131 shown in FIG. 2 which directs a spray of water radially away from the surface of the drum 22 at each cutting element 57 positioned opposite the mine face. The structural details of the spray nozzles are beyond the scope of the present invention and are disclosed in detail in U.S. Pat. No. 5,507,565 which is incorporated herein by reference.

Intermediate drum 52 includes an equal number of zones 232, 234, 236, 238, 240, 242, 244, and 246 in which spray nozzles are similarly located. Center drum 48 is somewhat different in that it includes only two zones 248 and 250 (see FIG. 3) in which its spray nozzles are located. Holes 196–210 in port plate 194 shown in FIG. 10 are connected to intermediate zone passageways 251 (see FIGS. 4–6) which, in turn, connect to zone passageways 252, 254, 256, 258, 260, 262, 264, 266, 268, 270, 272, 274, 276, 278, 280, 282 and 284 which feed water to the spray nozzles located in the above-mentioned zones 216–246.

With the above arrangement, each hole 196–210 in port plate 194 feeds at least two separate zones, one in the end drum 56 and the other in the intermediate drum 52. Also, one hole 196–210 must additionally feed the center drum zone 248 through zone passageway 256.

In FIG. 4 two sets of zone passageways are illustrated. Zone passageways 252, 254 and 256 form a first set on the back half of the end drum 56. Zone passageways 270 and 272 form a second set on the front half of end drum 56. In operation, water travels through passageway 150 of lip seal carrier 125 into manifold 190 through hole 196 in port plate 194 into intermediate passageway 251. The passageway 251 feeds zone passageway 270 to the end drum and zone passageway 272 to the intermediate drum, thereby feeding zones 216 and 232, respectively.

It should be understood that at the position illustrated in FIG. 4, only the front half of the end drum 56 receives water. The flow path illustrated on the back half is blocked off from receiving water by the valve plate 188. Thus a water spray is emitted from the nozzles of the cutting elements 57 only during the phases of rotation of the cutter drum assembly 22 when the cutting elements 57 and associated nozzles are positioned oppositely of the mine face. However, it can be seen that this flow path, if it were receiving water, would feed zone passageway 252 to the end drum zone passageway 254 to the intermediate drum, and zone passageway 256 to the center drum, thereby feeding zones 224, 240 and 248, respectively.

Similar flow paths occur with respect to each of the zones 216–246 mentioned above. It should be mentioned that center drum zone 248 is fed by only one zone passageway 256 in end drum 56. Likewise, center drum zone 250 is fed by a single zone passageway (not shown) in end drum 54. The port plate hole 204 (FIG. 9) in end drum 56 which feeds center drum zone 248 is positioned 180° from the port plate hole (not shown) in end drum 54 which feeds center drum zone 250. Since the respective valve plates 188 are positioned identically in each end drum 54 and 56, the spacing of the port plate holes which feed the center drum zones 248 and 250 permits the center drum nozzles (not shown) adjacent to the mine face to spray in opposing 190° segments with zone 248 being the first 190° segment and zone 250 being the second 190° segment, with zone 250 being fed as zone 248 is being cutoff, thereby permitting the center drum nozzles adjacent to the mine face to be fed by just two zones. FIG. 9 illustrates an end view of the port plate 194 and each of the zone passageways.

In an alternate embodiment, center drum 48 is provided with only one zone 248 which is fed by both zone passageway 258 originating in end drum 56 and the single zone passageway (not shown) in end drum 54 which receives water when zone passageway 258 is blocked by the valve plate 188. In this embodiment, water is continuously supplied to all the spray nozzles on the center drum simultaneously, either with water received from end drum 54 or from end drum 56.

To prevent water which originates from end drum 56 from traveling through center drum 48 and into end drum 54 during a period when those zones are shutoff, and vice versa, a check valve arrangement (not shown) is included in the zone passageways extending from end drums 54 and 56 into the center drum 48 to prevent water from flowing back into end drums 54 and 56 from center drum 48. This embodiment saves the need to split the center drum into two separate zones.

In another embodiment, eight separate zone passageways are formed by rifle drilling completely through the cutter drum assembly 22 from the end drums 54 and 56 to the center drum 48 to feed the center drum 48 in the same fashion as each intermediate drum. This arrangement is utilized in only limited applications due to the requirements of the machinery. Also, the water loss and muddy conditions created by the additional volume of water from continuous spraying is not large enough to overbalance the problems inherent in adding the additional zone passageways.

According to the provisions of the patent statutes, I have explained the principle, preferred construction, and mode of operation of my invention and have illustrated and described what I now consider to represent its best embodiments. However, it should be understood, within the scope of the appended claims, the invention may be practiced otherwise than as specifically illustrated and described.

I claim:

1. A phasing valve assembly for supplying liquid to a cutter drum of a mining machine comprising, a machine body portion, a boom member extending forwardly from said body portion, a cutter drum assembly rotatably mounted on said boom member, said cutter drum assembly having a pair of end drums and a plurality of intermediate drums positioned between said pair of end drums, said end drums and said intermediate drum being independently rotatably supported on said boom member, cutting elements secured to said cutter drum assembly and extending therefrom, bearing means for rotatably supporting said cutter drum assembly on said boom member, power means mounted on said body portion for rotating said cutter drum assembly, drive means for transmitting rotation from said power means through said boom member to said cutter drum assembly, spray nozzles carried by said cutting elements for directing a liquid spray from said cutting elements during rotation of said cutter drum assembly, conduit means extending from said body portion through said boom member and stationary with respect to said boom member for supplying liquid to said spray nozzles on said cutter drum assembly, a valve mechanism positioned in said cutter drum assembly and connected to said conduit means for selectively limiting the flow of liquid from said conduit means to said spray nozzles, said valve mechanism includes an annular port plate positioned axially in said cutter drum assembly, said port plate being rotatable with said cutter drum assembly, said port plate having a plurality of ports therein, a plurality of liquid passageways connected to said ports and extending through said intermediate drums and said pair of end drums, said liquid passageways rotatable with said intermediate and end drums to direct liquid from said port plate to said spray nozzles, sealing means for directing liquid from said non-rotating conduit means to said rotatable liquid passageways while preventing leakage of liquid into contact with said bearing means, and drainage means extending from said sealing means through said cutter drum assembly for diverting leakage away from said bearing means and externally out of said cutter drum assembly.

2. A phasing valve assembly as set forth in claim 1 in which, said cutter drum assembly includes an axially positioned annular manifold having a frontward portion and a rearward portion, said manifold being connected to said port plate to connect said manifold with said liquid passageways, said frontward portion of said annular manifold being fluidly connected to said conduit means for directing liquid through said annular manifold to said liquid passageways, a semi-annular valve plate rigidly connected to said boom member and positioned axially in said cutter drum assembly adjacent said annular port plate, and said semi-annular valve plate selectively restricting the flow of liquid from said conduit means to said liquid passageways.

3. A phasing valve assembly as set forth in claim 2 which includes, said semi-annular valve plate positioned adjacent to said manifold and extending through a preselected angle to prevent liquid from reaching said liquid passageways.

4. A phasing valve assembly as set forth in claim 3 which includes, said semi-annular valve plate extending through 170° in said rearward portion of said annular manifold.

5. A phasing valve assembly as set forth in claim 1 which includes, a lip seal carrier rigidly positioned adjacent said boom member, and said lip seal carrier including conduit means aligned with said conduit means in said boom member for directing liquid from said boom member conduit means to said liquid passageways.

6. A phasing valve assembly as set forth in claim 5 in which, said sealing means include said lip seal carrier having a lip seal positioned adjacent said bearing means to prevent liquid from contaminating said bearing means, and a plurality of O-rings surrounding the transition between said boom member conduit means and said lip seal carrier conduit means to prevent water from leaking into said bearing means.

7. A phasing valve assembly as set forth in claim 6 which includes, said lip seal carrier having an annular outside portion extending away from said boom member, said outside portion being contacted by an annular outer U-cup and an annular inner U-cup, said inner and outer U-cups being concentric to each other and rigidly connected to the cutter drum assembly, and said inner and outer U-cups sealingly engage said annular outside portion of said lip seal carrier during the rotation of said cutter drum assembly to prevent the leakage of water from the cutter drum assembly to the atmosphere.

8. A phasing valve assembly as set forth in claim 5 in which, said drainage means include said lip seal carrier including a radial passageway therein through which liquid is diverted away from said bearing means and externally out of said cutter drum assembly.

9. A phasing valve assembly as set forth in claim 1 which includes, said cutter drum assembly including first and second end drums, first and second intermediate drums, and a center drum, said liquid passageways including end drum passageways, intermediate drum passageways, and center drum passageways, said end drum passageways being positioned adjacent to the outer diameter of said first and second end drums for directing water to said nozzles on said first and second end drums, said intermediate drum passageways being positioned in said cutter drum assembly for directing water to said nozzles on said first and second intermediate drums, said center drum passageways extending along the centerline of said cutter drum assembly for directing water to said nozzles on said center drum, and said liquid passageways being operable to supply liquid simultaneously to said spray nozzles positioned on said first and second end drums, said first and second intermediate drums, and said center drum.

10. A phasing valve assembly as set forth in claim 9 which includes, said boom member including a first arm member for supporting said cutter drum assembly at a position between said first end drum and said first intermediate drum and a second arm member for supporting said cutter drum assembly at a position between said second end drum and said second intermediate drum, said conduit means including a first liquid path extending through and stationary with respect to said boom member for directing liquid through said first arm member and into said cutter drum assembly and a second liquid path stationarily extending through said boom member for directing liquid through said second arm member and into said cutter drum assembly, and said valve mechanism including first and second valve means for selectively limiting the flow of liquid from said first and second liquid paths to said spray nozzles.

11. A phasing valve assembly as set forth in claim 10 which includes, each of said first and second end drums, said first and second intermediate drums, and said center drum being divided into a plurality of zones, said liquid passageways corresponding to preselected zones for supplying liquid to said spray nozzles in said zones, said spray nozzles in said zones on said first end drum, said first intermediate drum, and half of said zones on said center drum being fed by liquid passageways connected to said first valve means, and said spray nozzles in said zones on said second end drum, said second intermediate drum, and half of said zones on said center drum being fed by liquid passageways connected to said second valve means.

12. A phasing valve assembly as set forth in claim 11 which includes, said first and second end drums and said first and second intermediate drums being divided into eight 45° zones, said center drum being divided into a first 180° zone and a second 180° zone, said first 180° zone being fed by said center drum passageway connected to said first valve means, and said second 180° zone being fed by said center drum passageway connected to said second valve means.

13. A phasing valve assembly as set forth in claim 12 which includes, said first 180° zone being positioned substantially opposite from said second 180° zone.

14. Apparatus for supplying phased liquid flow to a cutter drum assembly of a mining machine comprising, a machine body portion, a boom member extending forwardly from said body portion, a cutter drum assembly rotatably mounted on said boom member, said cutter drum assembly having a pair of end drums, a pair of intermediate drums, and a center drum, cutting elements secured to said cutter drum assembly and extending therefrom for dislodging material from a mine face, power means mounted on said body portion for rotating said cutter drum assembly, drive means for transmitting rotation from said power means through said boom member to said cutter drum assembly, spray nozzles carried by said cutting elements for directing a liquid spray from said cutting elements to the mine face during rotation of said cutter drum assembly, conduit means extending from said body portion through said boom member and stationary with respect to said boom member for supplying liquid to said cutter drum assembly, porting means rotatably connected to said conduit means for supplying liquid in phases to said spray nozzles during engagement of said cutting elements with the mine face, said porting means including an annular port plate positioned axially in said cutter drum assembly, said port plate having a plurality of ports therein, each of said ports being connected to a series of corresponding liquid passageways in said cutter drum assembly, said liquid passageways including end drum passageways, intermediate drum passageways and a center drum passageway, said end drum passageways positioned adjacent to the outer diameter of said end drums for directing water to said nozzles on said end drums, said intermediate drum passageways positioned in said cutter drum assembly for directing water to said nozzles on said intermediate drum assemblies, said center drum passageway extending along the centerline of said cutter drum assembly for directing water to said nozzles on said center drum, and said liquid passageways operable to supply water simultaneously to said spray nozzles positioned on said end drums, said intermediate drums, and said center drum.

15. A method for supplying liquid in phases to a cutter drum of a mining machine comprising the steps of, rotatably supporting a cutter drum assembly on a boom member extending forwardly of the mining machine, securing cutting elements to the surface of the cutter drum assembly, rotating the cutter drum assembly in contact with the mine face to dislodge solid material therefrom by the cutting elements, positioning spray nozzles on the surface of the cutter drum assembly adjacent to the cutting elements, directing a liquid spray from the nozzles during rotation of the cutter drum assembly, conveying liquid through a non-rotating strut from the boom member into the cutter drum assembly, dividing the cutter drum assembly into a plurality of sections, dividing each section of the cutter drum assembly into a plurality of zones for distributing liquid to the nozzles on the respective sections of the cutter drum assembly, directing the liquid from the non-rotating strut into a plurality of separate passageways within the cutter drum assembly, sealing the separate passageways to prevent liquid from escaping out of the cutter drum assembly, directing the liquid flow through the separate passageways in the cutter drum assembly into a manifold occupying a radial segment of the passageways for supplying liquid to the nozzles positioned oppositely of the mine face, conveying the liquid from the manifold to a ported plate positioned in liquid communication with the zones for directing liquid to the nozzles, and directing the liquid through the ported plate for distribution to each section of the cutter drum assembly for supplying the zones with liquid to emit from the nozzles a liquid spray only during the phase of rotation of the cutter drum assembly when the nozzles are positioned oppositely of the mine face.

16. A method as set forth in claim 15 which includes, dividing the cutter drum assembly into the plurality of sections including a pair of end drums, a pair of intermediate drums, and a center drum, and dividing each section of the cutter drum assembly into a plurality of non-overlapping zones, each zone comprising an angular sector of the cutter drum assembly.

17. A method as set forth in claim 16 which includes, dividing the center drum into two zones.

18. A method as set forth in claim 16 which includes, limiting the center drum to a single zone.

19. A method as set forth in claim 16 which includes, directing the liquid from the non-rotating strut into a selected number of end drum passageways, intermediate drum passageways, and center drum passageways, and connecting the passageways positioned nearest the mine face to nozzles for spraying liquid onto the mine face.

20. A method as set forth in claim 19 which includes, positioning the end drum passageways adjacent to the outer diameter of the end drums for directing water to the nozzles on the end drums, positioning the intermediate drum passageways in the end drums and intermediate drums for directing water to the nozzles on the intermediate drums, and positioning the center drum passageways along the centerline of the end drums, the intermediate drums, and the center drum.

21. A method as set forth in claim 19 which includes, positioning an end drum passageway in each of said zones, positioning an intermediate drum passageway in each of the zones, and positioning a center drum passageway in each of the zones.

22. A method as set forth in claim 19 which includes, obstructing the flow of liquid from the no-rotating strut to the passageways by a semi-annular valve plate having a preselected angle of arc positioned away from position adjacent the mine face.

23. A method as set forth in claim 22 which includes, extending the annular valve plate through a 170° arc to limit the flow of liquid supplied through the passageways to the nozzles positioned oppositely of the mine face.

* * * * *